US005515659A

United States Patent [19]

MacDonald et al.

[11] Patent Number: 5,515,659

[45] Date of Patent: May 14, 1996

[54] CONSTRUCTION SYSTEM USING PANELIZED INSULATION HAVING INTEGRAL STRUCTURAL FRAME

[76] Inventors: Angus W. MacDonald, 7358 Glengary Dr., Rapidan, Va. 22733; Paul F. Daspit, 6405 Wainfleet Ct., Springfield, Va. 22152

[21] Appl. No.: 242,893

[22] Filed: May 16, 1994

[51] Int. Cl.[6] ..... E04C 1/10

[52] U.S. Cl. ..... 52/474; 52/601; 52/247; 52/309.12; 52/344

[58] Field of Search ..... 52/309.4, 309.7, 52/309.8, 309.12, 309.17, 220.1, 220.8, 293.3, 293.1, 601, 344, 405.3, 405.1, 437, 438, 474, 247

[56] References Cited

U.S. PATENT DOCUMENTS

| | | | |
|---|---|---|---|
| 1,547,224 | 11/1923 | McLean | 52/344 X |
| 2,300,113 | 10/1942 | Faber | 52/293.3 X |
| 2,883,852 | 4/1959 | Midby | 52/601 X |
| 3,679,529 | 7/1972 | Prusinski et al. . | |
| 4,094,110 | 6/1978 | Dickens et al. . | |
| 4,185,437 | 1/1980 | Robinson | 52/601 |
| 4,223,500 | 9/1980 | Clark et al. . | |
| 4,241,555 | 12/1980 | Dickens et al. . | |
| 4,284,447 | 8/1981 | Dickens et al. . | |
| 4,287,691 | 9/1981 | Guenther | 52/247 X |
| 4,288,962 | 9/1981 | Kavanaugh . | |
| 4,409,768 | 10/1983 | Boden . | |
| 4,551,958 | 11/1985 | Reneault et al. . | |
| 4,554,124 | 11/1985 | Sudrabin | 52/601 X |
| 4,633,634 | 1/1987 | Hemmer et al. | 52/601 X |
| 4,641,468 | 2/1987 | Slater . | |
| 4,774,794 | 10/1988 | Grieb . | |
| 4,856,244 | 8/1989 | Clapp | 52/309.12 X |
| 4,862,660 | 9/1989 | Raymond . | |
| 4,936,069 | 6/1990 | Hunter et al. . | |
| 5,072,569 | 12/1991 | VanTassel . | |
| 5,172,532 | 12/1992 | Gibbar, Jr. | 52/309.12 |
| 5,359,816 | 11/1994 | Iacovides | 52/293.3 |
| 5,361,556 | 11/1994 | Menchetti | 52/601 X |

*Primary Examiner*—Wynn E. Wood

*Attorney, Agent, or Firm*—Millen, White, Zelano, & Branigan

[57] ABSTRACT

A building system for wall construction utilizes a prefabricated panel having two layers of foamed insulating sheets sandwiched around a layer of concrete or other cementitious material. Channels are cut into an interior face of one of the panels. The channels receive cement, which provides a reinforcing structure when hardened. Steel vertical channel studs encase the sandwiched layers on two sides of the panel. The vertical channel studs have a vertical surface which is fastened to a similar, opposing vertical channel stud of an adjoining panel to effectively create a vertical I-beam support when the panels are assembled together. The panels of the invention can be readily transported to a worksite, assembled, and finished on-site with a stress-skin to yield a wall which is extremely rigid, insulative, and resistant to forces such as fire, water, termites, and impact.

14 Claims, 5 Drawing Sheets

CONSTRUCTION SYSTEM USING PANELIZED INSULATION HAVING INTEGRAL STRUCTURAL FRAME

BACKGROUND OF THE INVENTION

1. Field of the Invention

The invention relates to prefabricated building panels which can be rapidly assembled to form structural walls for buildings of various types. Specifically, the invention relates to building panels which incorporate panels of insulating foam.

2. Related Art

Prefabricated building panels incorporating panels of foam insulation are known for providing rapid assembly of building walls having good insulating properties. Prefabricated building panels of this type typically utilize a frame of structural steel for surrounding the foam panel and imparting rigidity and strength thereto. U.S. Pat. No. 4,223,500 to Clark et al. discloses one such panel. The prefabricated building panel disclosed by Clark et al. utilizes a four-sided steel frame which forms a mold that is filled with liquid foam insulation. After the liquid foam insulation has set up in the frame, the panel can be assembled together with other panels to form a complete modular wall.

However, certain drawbacks are associated with the prior art panels which use insulating foam. For example, strength-to-weight ratios have been generally low. Panels which use polymer foams, such as polystyrene, require extensive reinforcement if such panels are to be used to form structural walls. If such reinforcement is made integral with the panel, such as by the addition of a heavy steel frame around the foam sheet, the panels become difficult to transport due to their heavy weight.

Further, insulating panels of the prior art have frequently required additional external reinforcement when used in applications that require walls to withstand high levels of stress. Such applications include, e.g., multi-story structures and structures built in areas prone to earthquakes. In such applications, the use of heavy steel I-beam studs is often necessary to impart the requisite amount of rigidity to walls constructed from insulative foam panels. However, the use of such external reinforcement is costly in that it adds additional steps and materials to the construction process.

SUMMARY OF THE INVENTION

It is therefore an object of the invention to provide an improved building panel system and method of manufacture thereof.

It is a further object of the invention to provide a building construction system utilizing prefabricated panels which are light weight yet provide a structural wall when assembled.

It is a further object of the invention to provide a building construction system with improved characteristics with respect to earthquake and hurricane resistance, moisture resistance, fire resistance, and insect and vermin resistance.

It is a further object of the present invention to provide a panelized building system suitable for fabrication of structural walls in multi-story applications, high-latitude structures, thermally-critical applications (such as wineries, laboratories, and the like), portable structures, emergency housing, schools, medical facilities, prisons, and/or military units.

In a preferred embodiment, the invention provides a building system for wall construction which utilizes a prefabricated panel having two layers of foamed glass insulating sheets sandwiched around a layer of concrete or other cementitious material. Channels are cut into an interior face of one of the panels. The channels receive cement, which provides a reinforcing structure when hardened. Steel vertical channel studs encase the sandwiched layers on two sides of the panel. The vertical channel studs have a vertical surface which is fastened to a similar, adjacent and opposite vertical channel stud of an adjoining panel to effectively create a vertical I-beam support when the panels are assembled together. The panels of the invention can be readily transported to a worksite, assembled, and finished on-site with a stressed-skin to yield a monocoque wall construction which is extremely rigid, insulative, and resistant to forces such as fire, water, termites, and impact.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating principles of the invention.

DETAILED DESCRIPTION OF THE DRAWINGS

Figure 1:
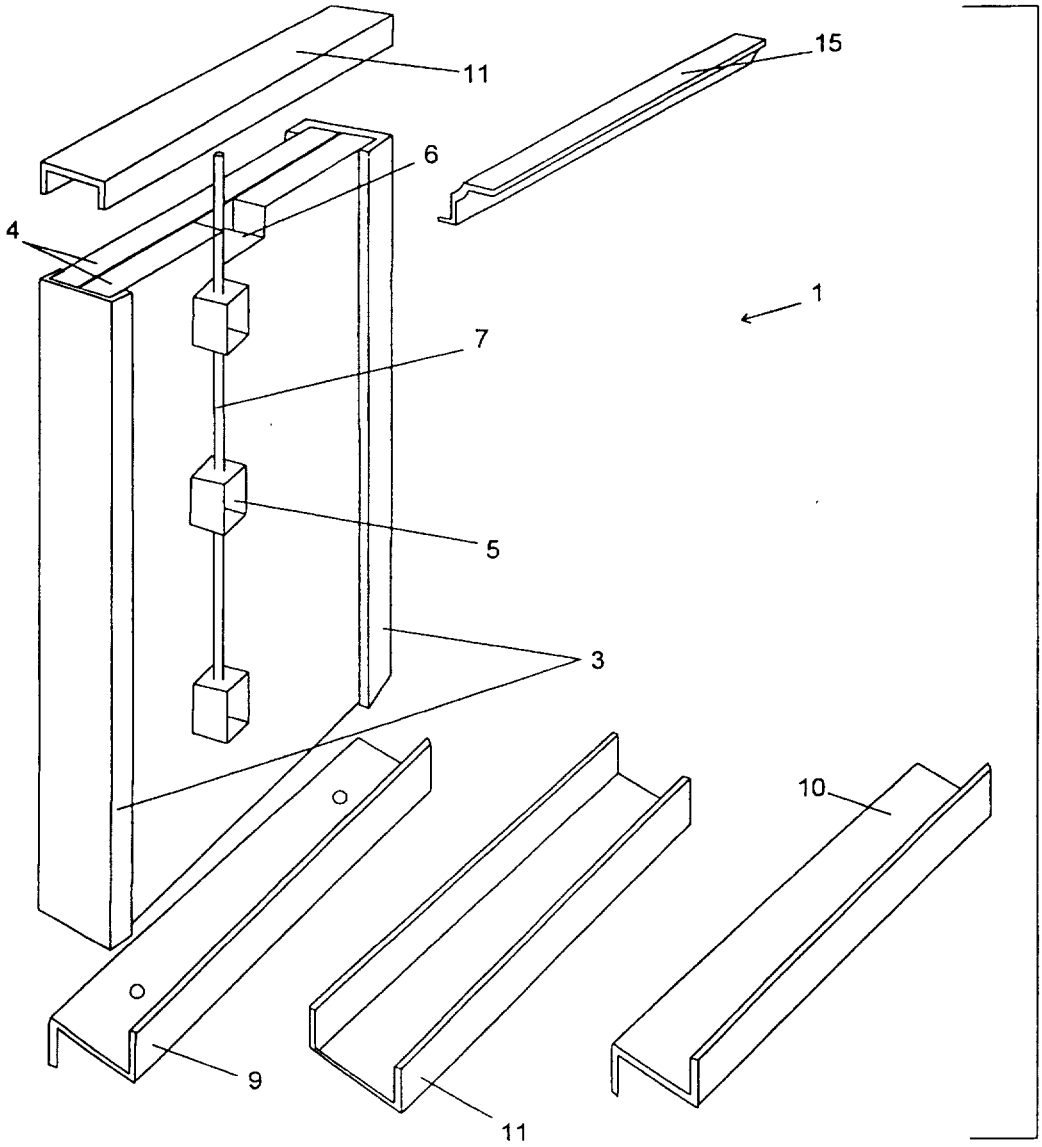
FIG. 1 illustrates principle elements of a building panel according to a first embodiment of the invention.

Referring to FIG. 1, a prefabricated structural panel 1 includes lightweight expanded masonry material 4. In the preferred embodiment of the invention, the expanded insulating material 4 includes at least two sandwiched layers which are encased on two sides by steel vertical channel studs 3. Expanded insulating material 4 preferably comprises cellular ceramic foam insulation material, but may comprise other materials such as expanded polystyrene, preformed urethane foam, any polymer foam, etc. In panels in which electrical services are to be embedded, a chase 7 and cutouts for electrical boxes 5 and conduit can be routed on an inside face of a sandwiched layer of expanded insulating material 4.

After the panels have been fabricated (as described below with reference to FIG. 3) they can be transported to the work site or other location where assembly of the panels into walls is to be performed. The lightweight panel design permits ease of transport of the panels during this stage of the construction system according to the invention.

At the worksite, panels are assembled on a prepared slab by first anchoring steel partition angles 9 and continuous Z-shaped perimeter wall plates 10 to the slab. Panel tops are aligned with continuous top partition channels 11. All joints are welded or screwed.

Where services are to be connected, wires or pipes are connected to those in conduits within the panels either laterally via a hollow steel crown 15 or vertically to the attic, roof, or floor slab.

Figure 2:
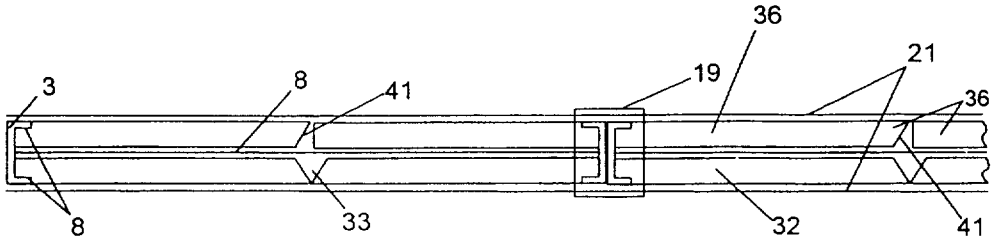
FIG. 2 is a top view illustrating the composition and relative placement of building panels according to the invention.

Referring to FIG. 2, when the vertical channel studs 3 are welded back-to-back, a wide-flange shape 19 is created, effectively creating a vertical I-beam.

The assembled walls are preferably finished on-site by applying continuous reinforced masonry finish 21, such as cement stucco, to both sides of the panels to create a composite stressed-skin structure with extremely high strength for the amount of material used. Alternative finishes 21 include masonry veneers, wood or other sidings screwed to vertical studs, and special decorative cement or acrylic stuccos.

Figure 3:
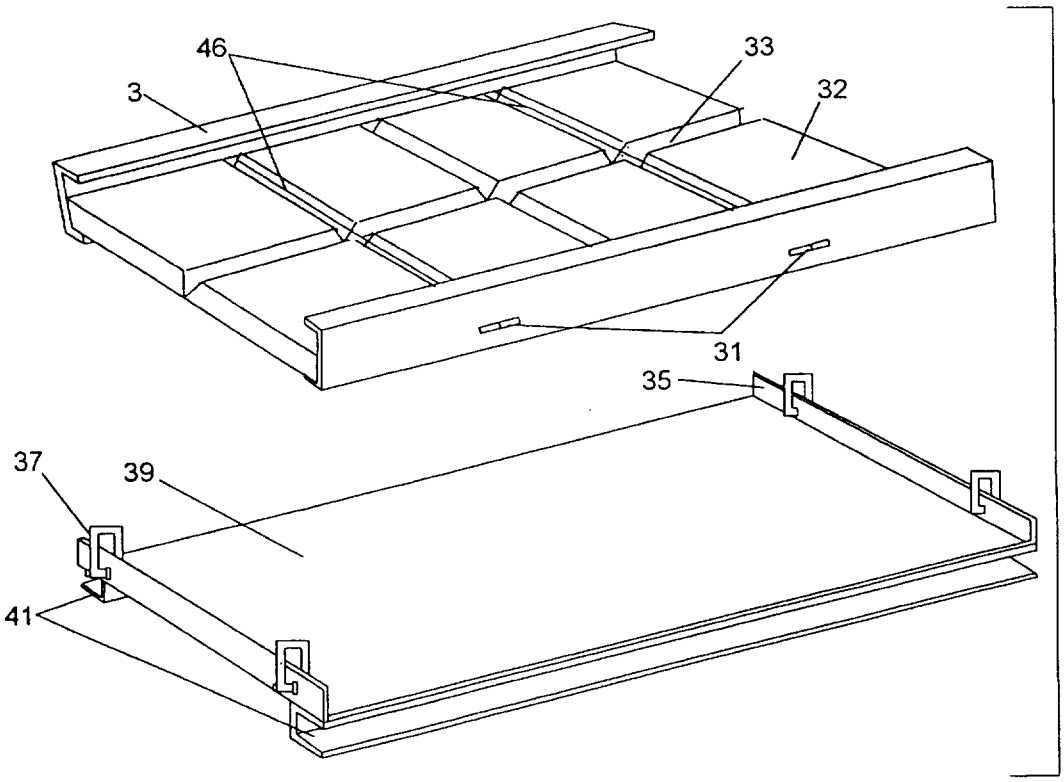
FIG. 3 illustrates certain aspects of the fabrication process of panels according to the invention.

As shown in FIG. 3, fabrication of a building panel according to a preferred method of the invention utilizes a sheet metal or plywood tray (or tabletop) 39 which is made with lips 35 of a depth approximately equal to the thickness of the panel to be fabricated. Tray 39 preferably has a width greater than that of the largest panel to be fabricated. The distance between the lips 35 matches the panel height, preferably 8 feet for a standard panel. For mass production, the width of the tray 39 can be set equal to the width of several panels to permit simultaneous fabrication of multiple panels. For increased rigidity, the tray 39 is preferably reinforced with steel beams 41.

Steel vertical channel studs 3 are preferably made with 16 to 20 gauge steel having an interior dimension equal to the sum of: (a) two layers of insulation, plus (b) a thin center slab, preferably ⅛ to ¼ inch. These vertical channel studs 3 are deformed approximately two feet from each end to create hooks 31 in each stud.

A bottom layer 32 of expanded insulation material is cut and bevelled to create triangular cavities 33 that criss-cross the panel's interior. A top layer 36 (FIG. 2) is cut and bevelled such that a triangular interior chase 41 runs from top to bottom of the panel.

Vertical wires between boxes 5 and the panel tops run along the space created by bevel 41. A notch 6 (FIG. 1) is cut in the top layer 36 to allow electrical wiring to exit at the top front face of the panel. As shown at reference character 8 in FIG. 2, the vertical edges of the top and bottom layers may be rabbeted to permit the vertical channel stud 3 to lie flush as it encases the top and bottom layers.

The panel fabrication process begins by placing two prepared vertical channel studs 3 along each side of the tray 39 and such that they are perpendicular to each lip 35. The vertical channel studs 3 are preferably temporarily affixed in position on the tray 39 by securing them to the lips 35 with clamps 37. Alternatively, for mass-production, the tray lips 35 may have small angles bolted thereto for consistently and accurately holding the vertical channel studs in proper alignment.

The bottom layer 32 of expanded insulation material is first placed on the tray between the vertical channel studs 3. The studs 3 are then tied together by looping steel wire 46 around the hooks 31 and twisting the ends of the steel wire such that the studs 3 securely encase the bottom layer 32. As shown in FIG. 3, the steel wire 46 runs between the studs along the horizontal ones of the triangular cavities 33.

A slab of concrete slurry 8 about ⅛ inch thick is spread over the entire bottom layer 32 of expanded masonry material. Triangular cavities 33 will be filled with concrete and thereby create triangular beams within the panel. These triangular beams add stiffness and create a diaphragm which takes the place of cross bracing and keeps the panels square. Additional wire or small reinforcing bars may be placed in the cavities 33 when reinforcement is required for extra strength, as in earthquake zones and multi-story building applications. Thin wire mesh or open weave fabric may be added to the slab 8 and embedded therein for additional rigidity.

While the slurry is still wet, the top layer of expanded masonry material is placed into position atop the bottom layer between the vertical channel studs 3, and any electrical service to be embedded is placed in the triangular cavities between the layers. The top layer is positioned by sliding it along the wet slurry surface into the channel of one of the studs 3, and then pressing or tapping the facing surface to tightly sandwich the layers together. The bevel 41 provides for a tight fit between horizontally-adjacent top layer sections 36.

When the cement slurry has cured to sufficient hardness and strength, the fabricated panel can be removed from the tray by loosening the clamps 37.

Where extra strong and assault-proof walls are required, a wire mesh or expanded metal sheets can be welded to the vertical channel studs 3 at one or both exterior panel surfaces.

Ornamentation can be applied at the factory by laminating onto the panels decorative elements such as keystones, jack arches, projecting jambs, sills, recessed or raised panels, niches, moldings, rosettes, pilasters, plinths, architraves, friezes, fascias, etc.

Figure 4:
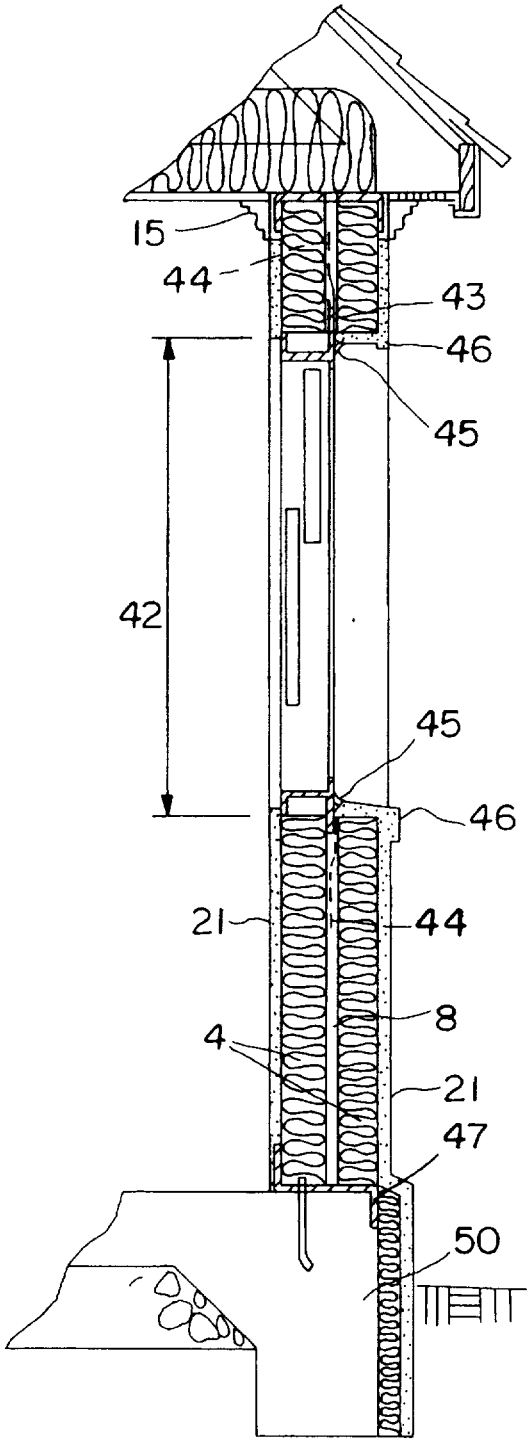
FIG. 4 illustrates an embodiment wherein a window is integrated with a panel according to the invention.

FIG. 4 illustrates an embodiment wherein a window is integrated with a panel of the invention. Most windows 42 have flanges 43 at the outside face. To fabricate a panel with an integrated window, insulation material 4 is cut to accommodate the window. When fabricating such a panel in its tray 39, the window is placed over the bottom layer of insulation material 32 so that the flange is imbedded in the slurry slab 8. Additional wire mesh reinforcement 44 is added overlapping the window flange 43 all around the perimeter of the window 42 before casting the slurry slab 8.

Figure 6:
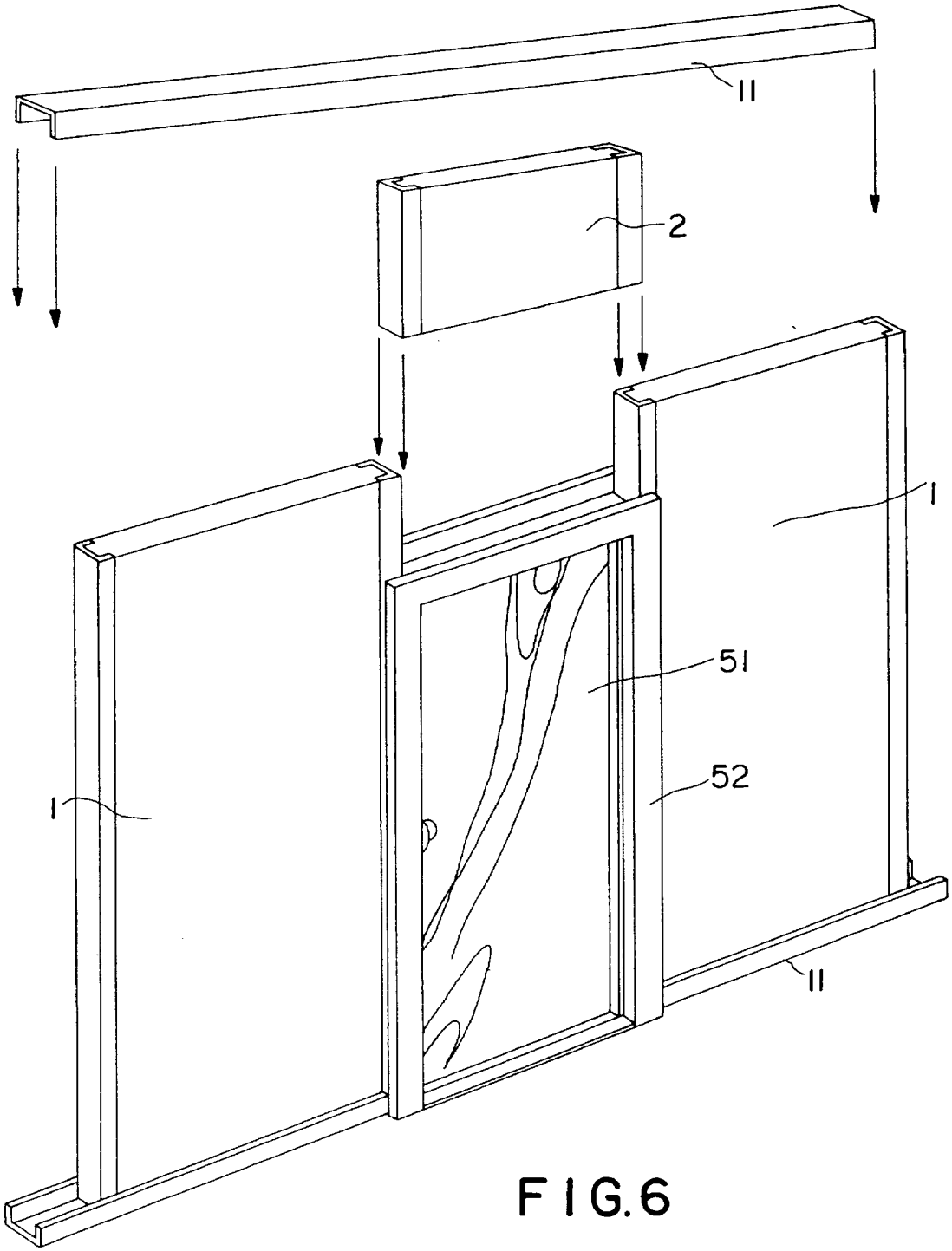
FIG. 6 illustrates an embodiment wherein a door assembly is integrated with panels according of the invention.

FIG. 6 illustrates an embodiment wherein a door assembly is integrated with building panels of the invention. Most doors 51 are sold hung in bucks 52 of wood or metal. Buck dimension is chosen so as to fit around panel 1. When assembling walls and partitions, the panels are aligned to allow for insertion of pre-hung doors in bucks between two panels. A small transom panel 2 fabricated to the dimension of the rough door opening fits between the door 51 and the ceiling or roof framing 49. The bottom plate will be cut away to allow set of the door threshold at floor level 50 between the pair of jamb panels 1 framing the door opening.

Figure 5:
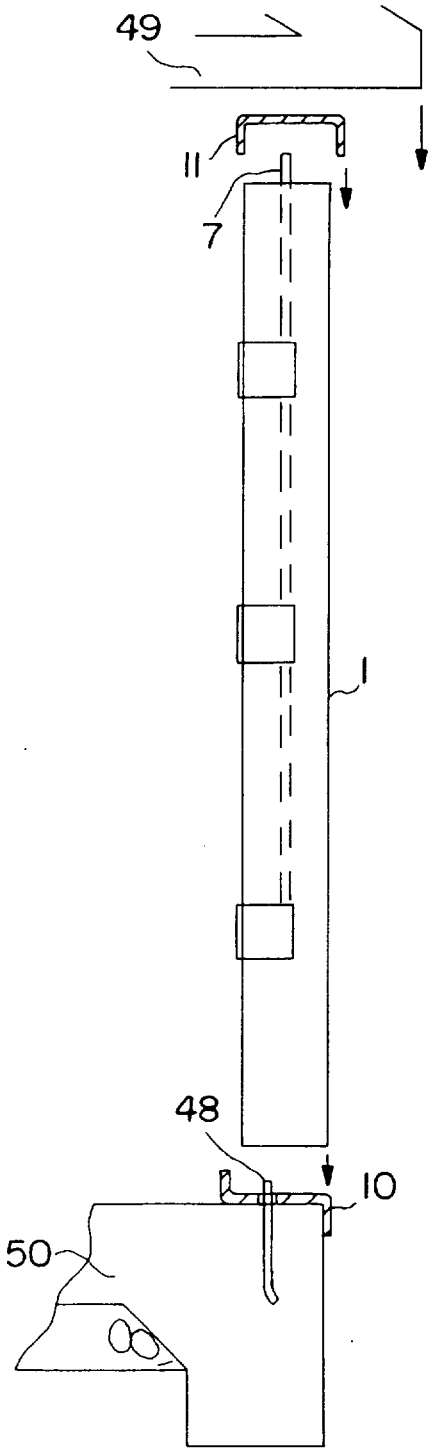
FIG. 5 illustrates an assembly process according to the invention.

On-site assembly of the panels to form walls will now be described with reference to FIGS. 1, 4, and 5. Assembly of a typical wall, partition, or integrated window or door panel is essentially the same. Partition panels rest in channels 11 or angles 9. Walls rest on Z shapes 10 positioned around the perimeter of the floor slab 50 in order to avoid moisture penetration at floor level. The plates 9, 10, and 11 are shown as shortened for purposes of illustration, but could run the entire length of a wall or could have other lengths dependent on the particular application. All these shapes will hereinafter be referred to as "bottom plates."

First the Z-shaped bottom plate 9 is drilled and placed over anchor bolts 48 projecting from the slab perimeter 50. It is adjusted and fastened with nuts and washers. The partition bottom plates 10 and/or 9 are positioned and fastened to the slab 50 using the Hilti or other anchorage system.

Panels 1 are placed and braced with necessary adjustments in their positions along the bottom plates which have been made and secured with self-tapping screws. Top channel 11 is drilled to accept electrical conduit 7, and placed over panel tops, and temporarily secured with self-tapping screws to stud tops 3. Truss, rafter, or other roof 49 or second-floor framing system is secured to top channels 11.

When all adjustments to the temporary screwed connections have been made to ensure plumb and properly aligned walls 1 and framing 49, all joints are welded and any temporary bracing removed.

A typical wall finishing procedure will be described with reference to FIG. 4. Outer and inner layers of cementitious stucco 21 are added to the wall and partition surfaces as well as to the additional insulation material 47 applied below grade to the slab edge 50 forming a plinth and water table around the building at floor level.

When finishing a window panel, the exterior face stucco application 21 is beveled all around the window to allow for caulking 45. Stucco 21 is formed to provide drip at the window head, and sloping projecting sill 46.

When finishing around the exterior face of an entrance door, a similar bevel groove is formed around the buck return to allow for caulking 45.

Crown molding 15 may be added to interior and exterior intersections of wall and partition tops, and the ceiling and eave soffit as trim, or in the case of concrete floor slabs, as a horizontal service chase.

Figure 7:
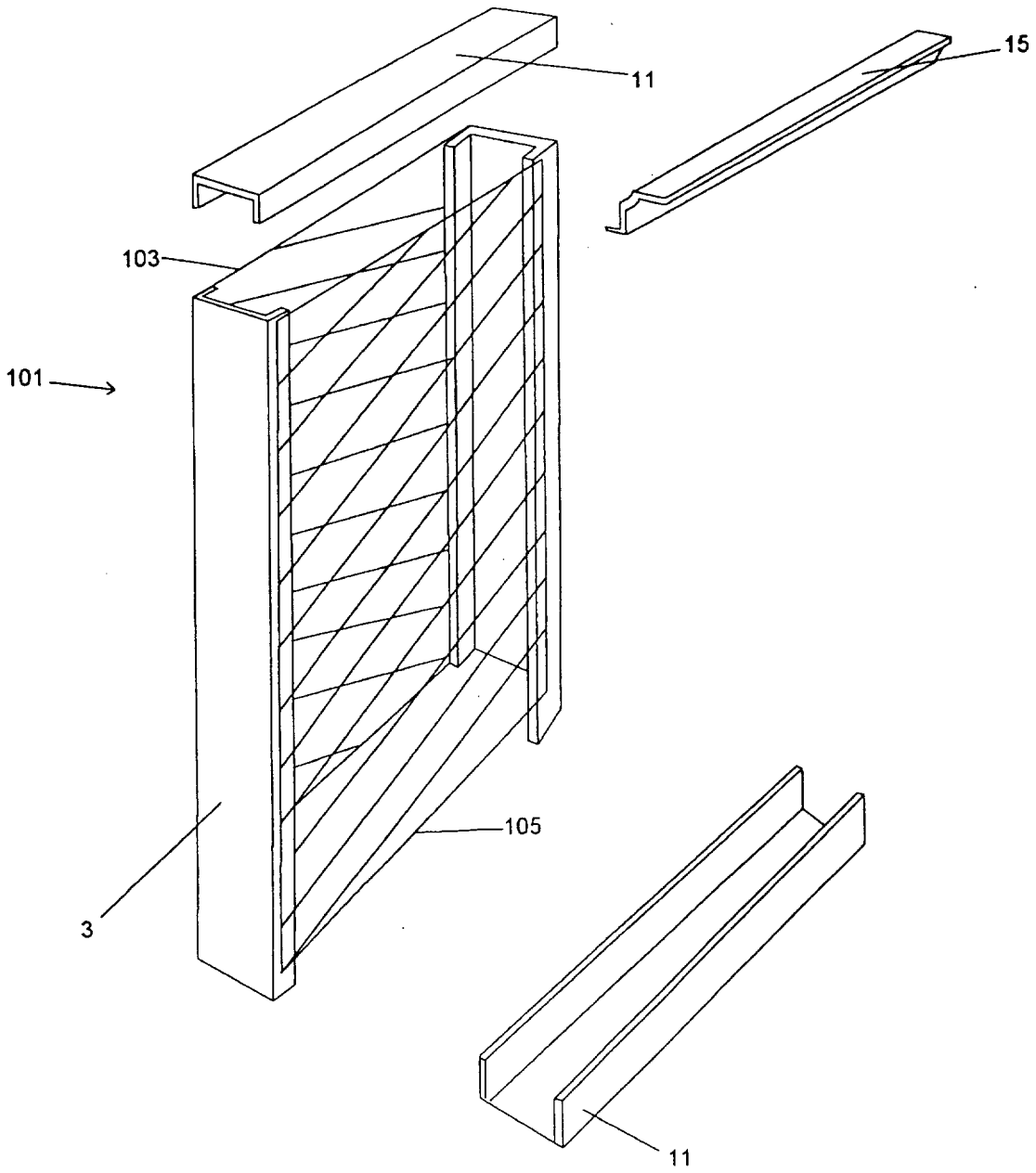
FIG. 7 illustrates an alternative embodiment of the invention wherein vertical channel members are connected via a lath extending therebetween.

An alternative embodiment of the invention is shown in FIG. 7. This embodiment, which utilizes wire mesh or other lath instead of panels of insulation between vertical channel members 3, is utilized, e.g., for constructing interior walls or partitions. Laths 103, 105 are welded or otherwise fastened to the rear and front facing sides, respectively, of vertical channel members 3. The laths 103, 105 preferably comprise wire mesh, but could alternatively comprise other suitable sheet-like material. Laths 103, 105 provide a foundation which receives finishing material such as plaster, cement, etc. An electrical wiring chase, conduit, and junction boxes can be integrated with a panel according to the present embodiment by fastening them along an interior vertical face of a vertical channel member 3.

While the invention has been particularly shown and described with reference to preferred embodiments thereof, it will be understood by those skilled in the art that various changes in form and details may be made therein without departing from the spirit and scope of the invention.

The embodiments of the invention in which an exclusive property or privilege is claimed are defined as follows:

1. A panelized construction system for forming structural walls, comprising:

a plurality of prefabricated panel members, each panel member abutting an adjacent panel member at vertical edge surfaces thereof to form a generally planar wall surface, each of said prefabricated panel members further comprising:

first and second vertical channel member means for providing a rigid structural frame;

generally-planar panel means extending between said first and second vertical channel means having first and second facing surfaces, said generally-planar panel means comprising first and second sandwiched layers of foamed insulation material having cementitious material therebetween;

a bottom plate means fastened to a floor surface, and extending horizontally along said floor surface, for receiving and retaining said plurality of prefabricated panel members at bottom portions thereof;

fastening means for fastening together adjacent panel members to form a monocoque wall structure; and, a stressed-skin surface applied to at least one of said facing surfaces whereby a substantially continuous rigid surface is formed across said plurality of prefabricated panel members; and, connecting means extending horizontally between said first and second vertical channel means and through an interior portion of said generally-planar panel means for fastening together said first and second channel means in a spatially separated manner.

2. The panelized construction system according to claim 1, wherein said first and second layers of foamed insulation each comprise foamed glass expanded masonry material.

3. The panelized construction system according to claim 1, wherein said connecting means comprises at least one retaining wire fastened at a first end to said first vertical channel means and at a second end to said second vertical channel means.

4. The panelized construction system according to claim 1, wherein said bottom plate means comprises a z-shaped perimeter wall plate.

5. The panelized construction system according to claim 1, wherein said bottom plate means comprises a U-shaped channel.

6. The panelized construction system according to claim 1, wherein said bottom plate means comprises a partition angle.

7. The panelized construction system according to claim 1, further comprising:

top channel means affixed to an overhead surface for receiving and retaining said plurality of prefabricated panel members at top portions thereof.

8. The panelized construction system according to claim 7, wherein said overhead surface comprises a roof means.

9. The panelized construction system according to claim 7, wherein said overhead surface comprises a second floor framing system.

10. The panelized construction system according to claim 1, wherein said stressed-skin surface means comprises a cementitious coating.

11. The panelized construction system according to claim 1, wherein said first layer of foamed insulation material has elongated cavities formed therein and wherein said cavities are at least partially filled with said cementitious material to create reinforcing beams between said first and second sandwiched layers.

12. The panelized construction system according to claim 1, wherein at least one of said prefabricated panel members includes a window assembly integrated therewith.

13. A panelized construction system for forming structural walls, comprising:

a plurality of prefabricated panel members, each panel member abutting an adjacent panel member at vertical edge surfaces thereof to form a generally planar wall surface, each of said prefabricated panel members further comprising:

first and second vertical channel member means for providing a rigid structural frame;

a sheet of generally-planar metal lath, having perforations therethrough, securely fastened to and extending between said first and second vertical channel member means for forming first and second facing surfaces;

a bottom plate means fastened to a floor surface, and extending horizontally along said floor surface, for receiving and retaining said plurality of prefabricated panel members at bottom portions thereof;

a top plate means fastened to an overhead surface, and extending horizontally along said overhead surface, for receiving and retaining said plurality of prefabricated panel members at top portions thereof;

fastening means for fastening together adjacent ones of said plurality of prefabricated panel members such that a vertical I-beam is formed by said first vertical channel means and a third vertical channel means, whereby a monocoque wall structure is created; and, a stressed-skin surface applied to at least one of said facing surfaces whereby a substantially continuous rigid surface is formed across each of said plurality of prefabricated panel members.

14. The panelized construction system according to claim 13, further comprising a first weld between said generally-planar metal lath and said first vertical channel member, and a second weld between said generally-planar metal lath and said second vertical channel member.

* * * * *